US007380888B2

(12) United States Patent
Ojanen

(10) Patent No.: US 7,380,888 B2
(45) Date of Patent: Jun. 3, 2008

(54) ROTATABLE CUTTING TOOL HAVING RETAINER WITH DIMPLES

(75) Inventor: Randall W. Ojanen, Bristol, TN (US)

(73) Assignee: Kennametal Inc., Latrobe, PA (US)

( * ) Notice: Subject to any disclaimer, the term of this patent is extended or adjusted under 35 U.S.C. 154(b) by 1238 days.

(21) Appl. No.: 09/838,348

(22) Filed: Apr. 19, 2001

(65) Prior Publication Data

US 2002/0153175 A1 Oct. 24, 2002

(51) Int. Cl.
*E21C 35/18* (2006.01)

(52) U.S. Cl. ..... 299/104

(58) Field of Classification Search ..... 299/102–107, 299/110–111; 37/465, 455, 458
See application file for complete search history.

(56) References Cited

U.S. PATENT DOCUMENTS

| | | | | | |
|---|---|---|---|---|---|
| 3,397,012 | A | * | 8/1968 | Krekeler | 299/104 |
| 3,405,831 | A | * | 10/1968 | Hudson | 215/330 |
| 3,512,838 | A | * | 5/1970 | Kniff | 299/104 |
| 3,519,309 | A | | 7/1970 | Engle et al. | 299/86 |
| 3,752,515 | A | * | 8/1973 | Oaks et al. | 403/344 |
| 3,801,158 | A | * | 4/1974 | Radd et al. | 299/104 |
| 3,841,708 | A | * | 10/1974 | Kniff et al. | 299/104 |
| RE29,900 | E | * | 2/1979 | Kniff | 299/104 |
| 4,201,421 | A | | 5/1980 | Den Besten et al. | 299/86 |
| 4,247,147 | A | * | 1/1981 | Rettkowski | 299/110 |
| 4,327,947 | A | | 5/1982 | Bower, Jr. | 299/86 |
| 4,484,783 | A | | 11/1984 | Emmerich | 299/86 |
| 4,485,655 | A | | 12/1984 | Ewing | 72/68 |
| 4,489,986 | A | * | 12/1984 | Dziak | 299/104 |

(Continued)

FOREIGN PATENT DOCUMENTS

DE 3144060 5/1983

(Continued)

OTHER PUBLICATIONS

Kennametal Construction Tooling Catalog, B99-003(10)C9, Kennametal Inc., Latrobe, PA, (1999).

(Continued)

*Primary Examiner*—Sunil Singh
(74) *Attorney, Agent, or Firm*—Matthew W. Smith

(57) ABSTRACT

A cutting tool assembly including a cutting bit having a head and a cylindrical shank portion of substantially constant diameter depending from the head as well as a bit holder including a cylindrical bore for receiving the cylindrical shank portion of the cutting bit. The shank portion includes an annular recessed groove. The cutting tool assembly further includes a retainer sleeve disposed between the shank portion of the cutting bit and the bore of the bit holder and which closely conforms about the shank portion while allowing the shank portion to rotate within the bore. The retainer sleeve includes at least one inwardly folded over stop tab that cooperates with the recessed groove to axially position the shank within the retainer. The retainer includes stop tabs that are bent around beyond the shear cut lines of the tab opening so that the hub portions of the shank do not transmit a force against these weakened shear cut areas of the retainer. The shank hub is positioned so that the hub rotates against only those portions of the retainer that are not weakened by shear line openings.

18 Claims, 6 Drawing Sheets

U.S. PATENT DOCUMENTS

| | | | | | |
|---|---|---|---|---|---|
| 4,538,339 | A | | 9/1985 | Ewing | 29/510 |
| 4,575,156 | A | | 3/1986 | Hunter et al. | 299/92 |
| 4,582,364 | A | | 4/1986 | deMey, III | 299/92 |
| 4,684,176 | A | | 8/1987 | Den Besten et al. | 299/91 |
| 4,728,153 | A | * | 3/1988 | Ojanen et al. | 299/107 |
| 4,836,614 | A | | 6/1989 | Ojanen | 299/86 |
| 4,850,649 | A | | 7/1989 | Beach et al. | 299/92 |
| 4,921,310 | A | | 5/1990 | Hedlund et al. | 299/92 |
| 5,067,775 | A | * | 11/1991 | D'Angelo | 299/104 |
| 5,181,867 | A | * | 1/1993 | Rodondi et al. | 439/854 |
| 5,503,463 | A | | 4/1996 | Ojanen | 299/107 |
| 5,536,073 | A | * | 7/1996 | Sulosky et al. | 299/106 X |
| 5,628,549 | A | * | 5/1997 | Ritchey et al. | 299/104 |
| 5,645,323 | A | * | 7/1997 | Beach | 299/111 |
| 5,730,502 | A | * | 3/1998 | Montgomery, Jr. | 299/104 |
| 5,807,049 | A | * | 9/1998 | Beck et al. | 411/31 |
| 5,861,572 | A | * | 1/1999 | Schuermann | 102/449 |
| 5,931,542 | A | | 8/1999 | Britzke et al. | 299/104 |
| 6,000,153 | A | * | 12/1999 | Sollami | 299/106 X |
| 6,164,728 | A | * | 12/2000 | Sollami | 299/104 |
| 6,199,956 | B1 | * | 3/2001 | Kammerer | 299/111 |
| 6,378,952 | B1 | * | 4/2002 | Moosmann et al. | 299/104 |
| 6,397,652 | B1 | * | 6/2002 | Sollami | 72/360 |
| 6,561,058 | B1 | * | 5/2003 | Steinke | 74/551.9 |

FOREIGN PATENT DOCUMENTS

| | | |
|---|---|---|
| DE | 3701905 | 9/1988 |
| DE | 3712427 | 10/1988 |
| DE | 4306206 | 9/1994 |
| DE | 29614096 | 12/1997 |
| DE | 19720635 | 11/1998 |
| EP | 0264015 | 4/1988 |
| EP | 0295232 | 12/1988 |
| EP | 0639437 | 2/1995 |
| WO | 9727383 | 7/1997 |
| WO | 0043636 | 7/2000 |

OTHER PUBLICATIONS

Kennametal Road Planing, Soil Stabilization, and Reclamation Tools Catalog, B01-1(12)D1, Kennametal Inc., Latrobe, PA, (2001).

Kennametal Cutting and Drillings Systems . . . for Underground and Surface Mining Catalog, B00-023(10)JO, Kennametal Inc., Latrobe, PA (2000).

PCT Communication Relating to the Results of the Partial International Search in Application No. PCT/US02/09634, International Filing Date Mar. 27, 2002, mailed Jun. 17, 2002.

PCT International Search Report in Corresponding Application No. PCT/US02/09634, International Filing Date Mar. 27, 2002, mailed Oct. 10, 2002.

* cited by examiner

ROTATABLE CUTTING TOOL HAVING RETAINER WITH DIMPLES

BACKGROUND OF THE INVENTION

1. Field of the Invention

The present invention relates to rotatable cutting tool assemblies and more specifically to rotatable cutting tool assemblies having sleeve retainers for removable attachment of the cutting tool within a bored tool holder.

2. Description of the Related Art

The present invention is directed toward a cutting tool assembly employed in earth working, mining or construction applications wherein a cutting bit is held on a mounting block or bit holder that is affixed to a movable member. Such cutting tool assemblies have been employed for various excavating operations. These excavating operations can include removal of minerals as well as trenching, concrete cutting, road planing and other construction applications. The effective life expectancy of cutting tools is determined by the cutting tool's ability to be securely held in place and yet be free to rotate in order to promote uniform wear on the respective tip portions. While earlier cutting tool assemblies have performed satisfactorily, certain problems or drawbacks have existed, and the subject invention is directed toward overcoming these problems.

There is a need in the art for a cutting tool assembly wherein the cutting bit will be adequately retained within the mounting block for an extended lifetime without inadvertent removal of the cutting bit due to the forces acting thereon during excavating operations.

Prior art cutting tool assemblies have employed cylindrical retainer sleeve clips with cutting tool shanks that have an annular groove closer to the rear portion of the shank for receiving stop tabs that axially fix replaceable cutting tools inside the bore of a bit holder. In U.S. Pat. No. 5,503,463 to Ojanen, a cylindrical retainer has inward stop fingers that are received by the annular groove on the shank and outwardly directed fingers that are received in an annular groove in the bit holder bore sidewall.

In U.S. Pat. No. 4,921,310 to Hedlund and U.S. Pat. No. 4,684,176 to Den Besten prior art designs, the fingers are formed by shear cuts made in the retainer and deflecting the finger stops radially inward. FIGS. 1-3 are representative of such prior art cutting tool assemblies. In these prior art designs the retainers often failed prematurely due to cracks and splits that developed at a shear cut edge at the axially rearward end of stop tab opening. Such stop tab opening shear cut lines locally weakens the retainer's strength and resistance to fracture. As shown at 7 in FIG. 3, cracks/splits in the prior art retainers propagated at these shear cut lines on the retainer's stop tab opening primarily along the axial direction of the retainer or in a direction perpendicular to the axial direction of the retainer. In FIG. 2 the hub 2 of the prior art cutting tool's shank contacts and rotates up against the stop tab openings 4 rearward shear cut line 6 during heavy loads. This contact in prior art designs applies a shearing force that is concentrated along the retainer opening and causes a propagating fracture. German patent application DE 109720635A1 to Moosmann discloses stop fingers 26 and a cooperating groove 27 for axially positioning the cutting tool shank within the bit holder. Such designs are more likely to fracture/crack along the shear cut lines than along the other positions of the retainer.

The fracture of the retainer in the field causes difficulty in removing the retainer from the bit holder. When an operator attempts to remove the retainer for replacement, it occasionally breaks off and additional time and tools are needed to remove the portion of the retainer remaining in the bit holder. In the prior art the cutting tool and a portion of the retainer are dislodged during operation when a reverse load is applied to the cutting tool.

Fractured retainers make used tools difficult to remove or the retainer sticks in the bore and the tool shank is ejected without the retainer. The retainer must then be driven out separately. This creates production delays in changing the tool. A fractured retainer typically takes 5 minutes to change whereas an undamaged retainer can be removed in about 30 seconds. It isn't unusual that it may take 30 minutes to remove a fractured retainer from a support block. A typical change of the set of tools on a have lane construction machine normally takes about 30 minutes. If 2-3 retainers are fractured it can take from anywhere between 15-90 minutes more time. This additional downtime needed to remove fractured retainers increases required labor costs.

Retainer fracture and failure in the prior art is often attributed to relative axial movement between the retainer and cutting tool shank. In U.S. Pat. No. 4,921,310 to Hedlund, retainer stop tabs 12 are received in an annular groove on the cutting tool shank. The amount of axial play of the cutting tool in prior art devices such as the embodiment in FIG. 6 of Hedlund increases during the lifetime of the tool on account of wear occurring to the stop fingers.

The premature wear and fracture of cylindrical retainers on cutting tool assemblies requires the cutting tool assemblies to be more frequently replaced and/or inspected. When the retainer is worn or fractured the shank of the tool oftentimes becomes locked up and stops rotating. Once the tool stops rotating the cutting tool bit becomes unevenly worn on one side and the cutting bit quickly becomes damaged and inoperative. Some cutting bits are knocked out and become lost after the retainer is fractured or worn. Other bits become locked within the bit holder as the worn retainer pieces wedge the shank within the bit holder. Such bit holders on rotary drums must be removed and attached back onto the drum.

The subject invention overcomes the problems in the prior art in a cutting tool assembly having a retainer scheme which effectively and rotatably retains the cutting bit within the mounting block while at the same time preventing premature failure of the cutting bit retainer during excavating operations.

SUMMARY OF THE INVENTION AND ADVANTAGES

The subject invention is directed toward a cutting tool assembly including a cutting bit having a head and a cylindrical shank portion of substantially constant diameter depending from the head and a bit holder including a cylindrical bore for receiving the cylindrical shank portion of the cutting bit. The shank portion includes an annular recessed groove. The cutting tool assembly also includes a retainer sleeve disposed between the shank portion of the cutting bit and the bore of the bit holder. The retainer closely conforms about the circumference of the shank portion while allowing the shank portion to rotate within the bore. The retainer includes at least one inwardly projecting folded over stop tab contacting an axially outward facing surface formed by a groove on the shank of a cutting tool.

An object of the invention is to prevent fracture/crack propagation adjacent the shear cut lines of the stop tab openings on a retainer. The applicant's invention positions the shank so that the shank hub contacts the retainer axially rearward and away from the weak shear cut lines of the retainer from which cracks propagate in the prior art. The retainer of applicant's invention includes stop tab tips beyond the shear cut lines of the tab opening so that the hub portions of the shank do not transmit a force against these weakened shear cut edges of the stop tab openings.

Another feature of the invention is the shear cut lines of the stop tab openings are rounded to prevent stress concentration of loads as occur in sharp angled corner openings.

The invention cutting tool's axial play when the cutting tool is in the bit holder is limited by the cooperation of the stop tab and shank groove. The outward most position of the cutting tool is limited by the contact between the tip of the stop tab and an annular outward facing surface of a shank groove and the most inward position of the cutting tool is limited by the contact of the other opposite inward facing surface of the groove and bendtop of the folded over end portion of the tab.

In another embodiment of the invention the cutting tool's outward axial play is confined by the tip of the folded over stop tab contacting the outwardly facing annular edge surface of the shank groove and inward axial movement of the cutting bit is limited by cooperation of the outward endface of the cylindrical retainer and an annular surface of the neck of the cutting bit shank as in the prior art. However in this second embodiment of the invention the bendtop of the folded over portion of the stop tab is initially designed to be adjacent but not abutting the other opposite face of the groove; however, as the shank and retainer begin to wear during use and the tool begins to develop more axial freedom/play, the other opposite surface of the groove abuts the folded over end portion of the tab.

Another alternative embodiment has a shank portion that includes an annular recessed groove, and the cylindrical bore has a notch corresponding to and disposed opposite the annular groove. The retainer has stop tabs that are received in the groove and dimples that are received in the bore notch. This invention improves attachment of the cutting bit within the bore of the bit holder and prevents axial removal of the cutting bit when in use while still allowing rotatable movement of the cutting bit within the bore.

In this way, the cutting bit of the cutting tool of the subject invention may be rotatably retained within the bit holder, while, at the same time, successfully resisting axial removal during excavating operations. In mining machines such as continuous miners, road working machines like road planers, and earth moving machines such as mechanized shovels, a plurality of cutting bits are mounted on these apparatus for cutting earth strata or man made surfaces such as asphalt.

Other features and advantages of the present invention will be readily appreciated as the same becomes better understood after reading the subsequent description when considered in connection with the accompanying drawings:

DESCRIPTION OF THE PREFERRED EMBODIMENT(S)

Figure 1:
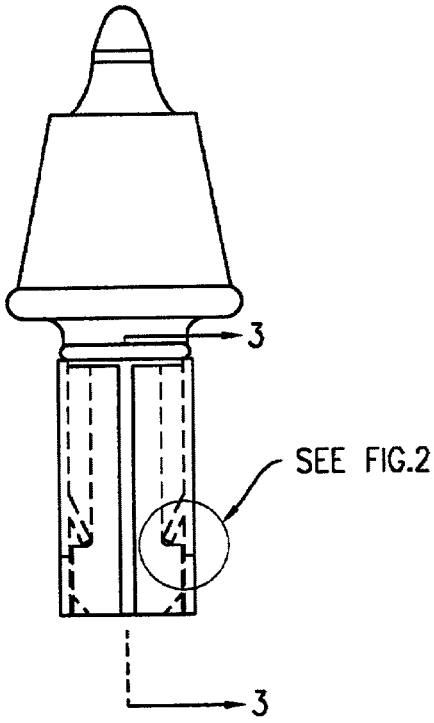
(PRIOR ART) FIG. 1
FIG. 1 illustrates a prior art cutting tool including a cylindrical sleeve connected to the shank.
Figure 2:
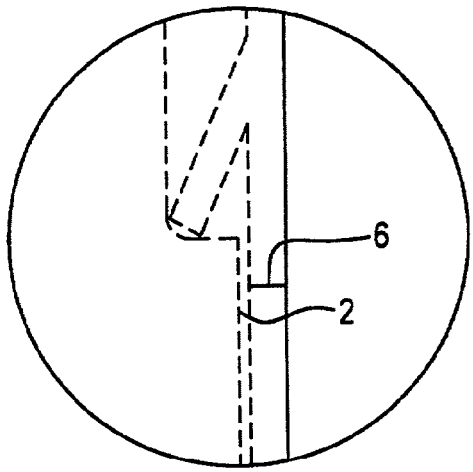
(PRIOR ART) FIG. 2
FIG. 2 is a magnified view of FIG. 1 illustrating the shank hub being in contact with the shear edge of the opening.
Figure 3:
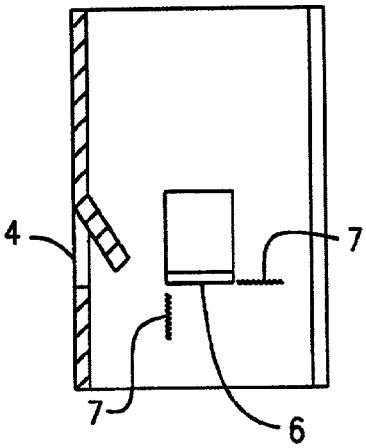
(PRIOR ART) FIG. 3
FIG. 3 is a view taken along line 3-3 in FIG. 1 that illustrates crack failures that occur on prior art retainer designs.
Figure 4:
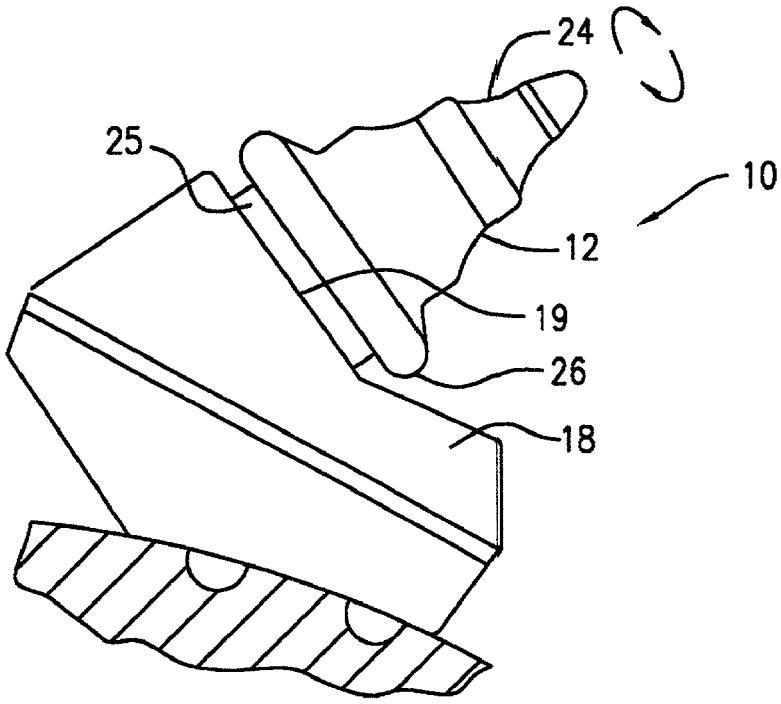
FIG. 4 is a perspective view of a cutting tool assembly of the invention mounted on a mining/construction drum.
Figure 5:
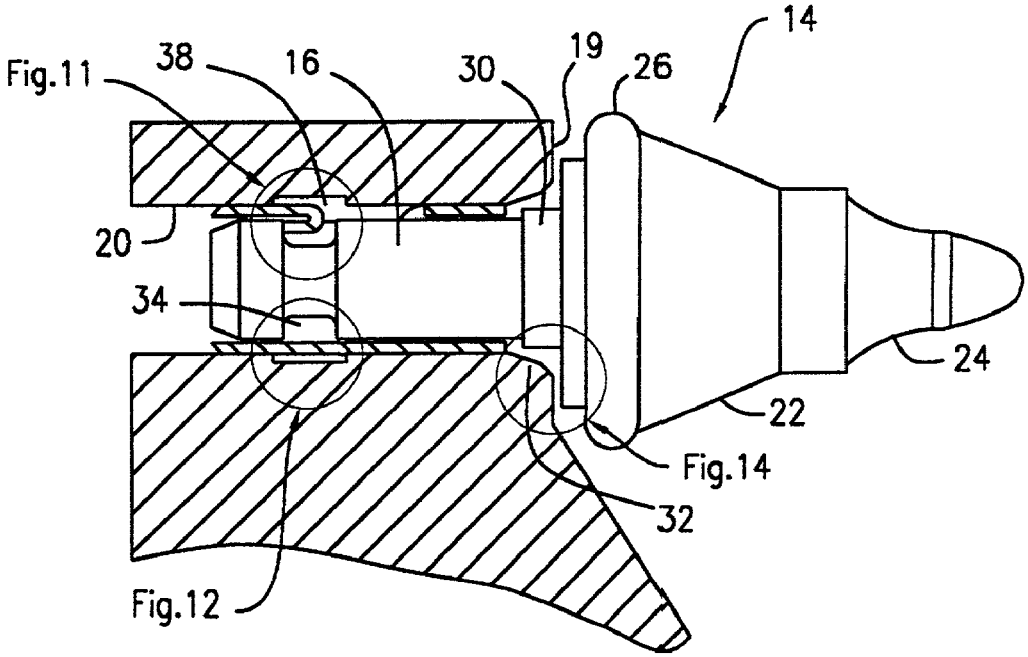
FIG. 5 is a partial cross-section view of the cutting tool assembly.

Referring now to the drawings and specifically to FIGS. 4 and 5, a rotating cutting tool assembly is generally shown at 10. The assembly 10 includes a cutting bit, generally shown at 12, having a head generally indicated at 14 and a cylindrical shank portion 16 of substantially constant outer diameter extending from the head 14. The assembly 10 also includes a bit holder, generally indicated at 18 including a generally cylindrical bore 20 for receiving the cylindrical shank portion 16 of the cutting bit 12.

The head 14 includes a body 22 and a cutting element 24 disposed on one side of the body 22 and at the distal end of the cutting head 14. The head 14 also includes an annular shoulder 26 disposed on the other end of the body 22 opposite the cutting element 24. A washer 25 is positioned between the shoulder 26 and a front face 19 of the bit holder. The annular shoulder 26 has a diameter larger than the outside diameter of the washer 25. The washer is adapted for abutting contact with the front face 19 of the bit holder 18. The shoulder 26 is adapted for abutting contact with the other face of the washer.

The washer has an outside diameter larger than the diameter of a flared mouth of the bit holder bore 20. The smaller diameter washer permits access of a removal tool between the front face of the bit holder and cutting tool shoulder so that the cutting tool can be pried off the bit holder with the removal tool. A cylindrical neck portion 30 merges between the annular shoulder 26 and the shank portion 16 of the cutting bit 12.

Figure 14:
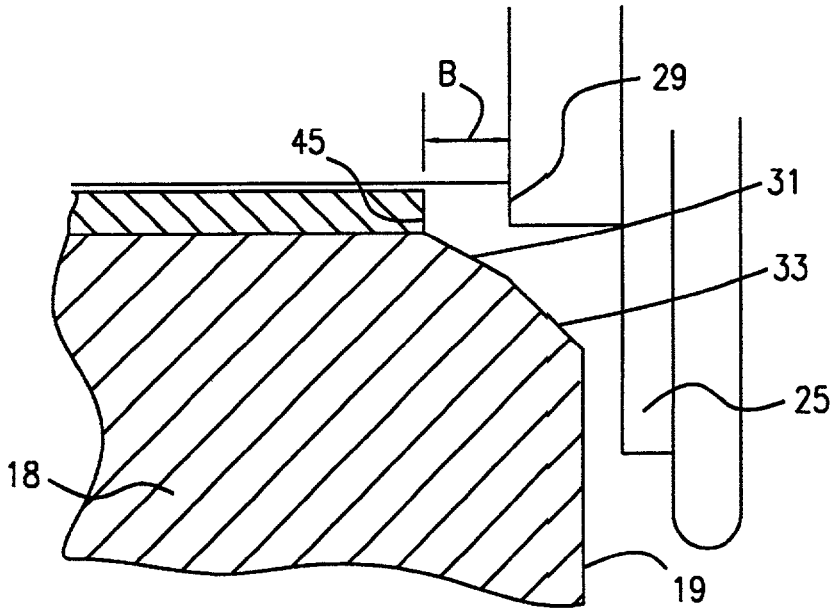
FIG. 14 is a magnified view of a second embodiment.

The flared mouth 32 as best seen in FIG. 14 comprises a front portion 33 angled at 45 degrees with respect to the central axis of the bit holder bore. A rearward portion 31 of the flared mouth is between and contiguous with both the front mouth portion 33 and the cylindrical bore of the bit holder 20. This rearward mouth portion 31 is angled at about 30 degrees with respect to the central axis of the bit holder bore. The flared mouth section of the bore provides for a smooth reception of the shank/retainer of the cutting tool during installation of the cutting tool into the bit holder.

The bottom end of the retainer 51 is chamfered between about 30-45 degrees with respect to the central axis of the retainer. This chamfer provides for additional ease in the reception of the retainer into bit holder bores.

Figure 11:
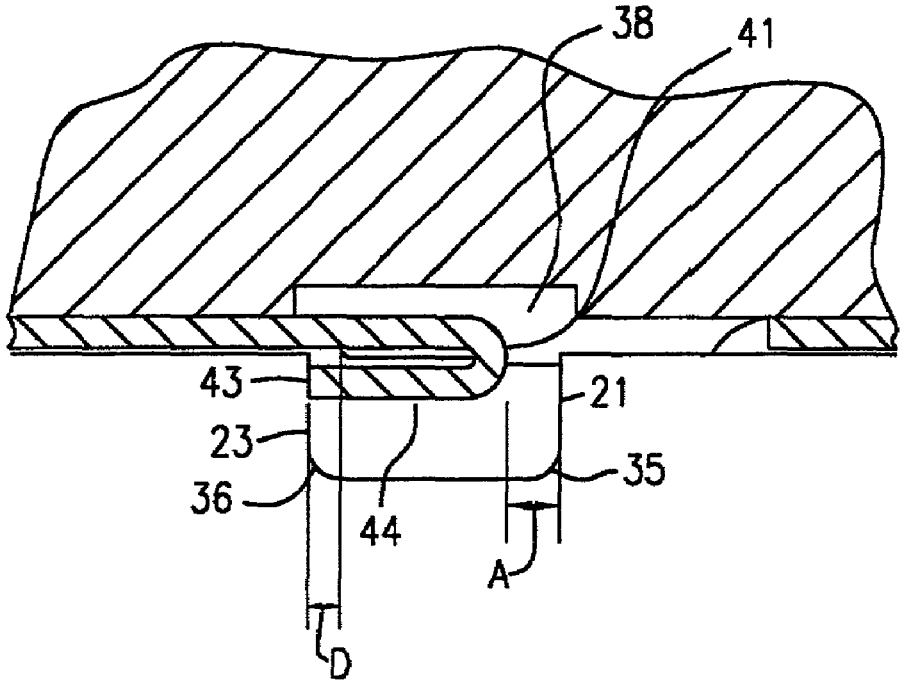
FIG. 11 is a magnified view of FIG. 5.
Figure 12:
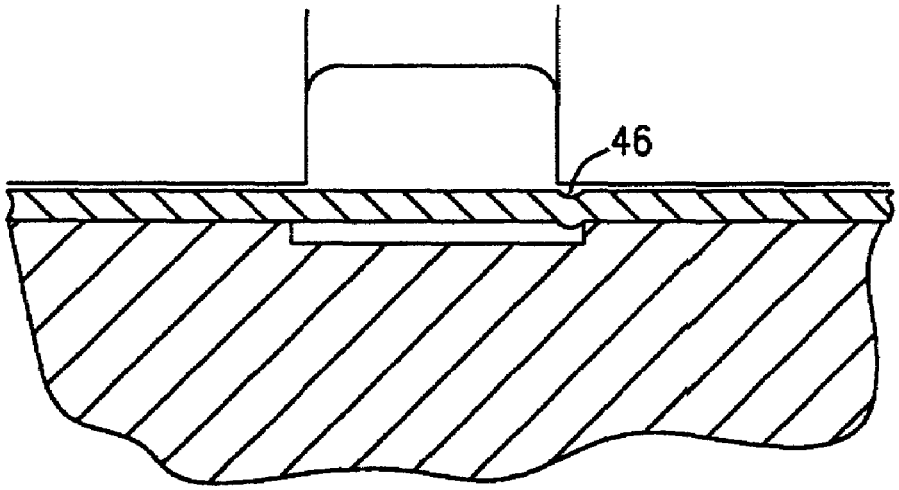
FIG. 12 is a magnified view of FIG. 5.

The shank portion 16 includes an annularly recessed groove 34. The annularly recessed groove 34 as shown in FIG. 11 is bounded on its edges by outward facing annular surface 23 and an opposite rearward facing surface 21. Both annular edge surfaces extend between the groove 34 and the outer diameter of the shank portion 16. The generally cylindrical bore 20 includes a notch 38 corresponding to and disposed opposite the annularly recessed groove 34.

Figure 6:
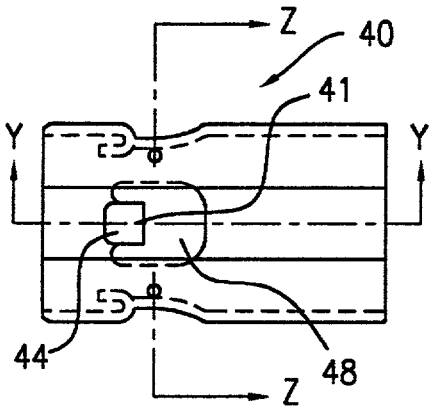
FIG. 6 is a side view of the invention retainer.

The cutting tool assembly 10 further includes a retainer sleeve, generally indicated at 40 in FIG. 6. As seen in FIG. 5 the retainer is disposed between the shank portion 16 of the cutting bit 12 and the bore 20 of the bit holder, and the retainer closely conforms about the shank portion 16 while allowing the shank portion to rotate within the bore 20. The retainer is cylindrical in shape having a central longitudinal axis and includes a slit 42 extending along the entire axial length of the retainer 40. The retainer 40 includes at least one, but preferably a plurality of inwardly folded over stop tabs 44 which, once assembled, are received within the recessed groove 34 about the circumference of shank. The inwardly folded over stop tabs 44 are generally equally spaced relative to one another about the circumference of the retainer sleeve 40 and extend into the recessed groove 34. When the shank moves outward on account of reverse loading the folded over stop tabs are placed in tension. The applied tensional force during typical reverse loading causes the stop tabs 44 to be elastically deformed. The stop tabs within the limits of elastic deformation of the stop tab material becomes spring loaded. The prior art stop tabs are placed in compression and do not elastically deform. Once the applied reverse load force is removed from the folded over stop tabs 44, the spring-loaded stop tabs 44 displace the shank of the cutting tool inward into an unbiased position.

Figure 7:
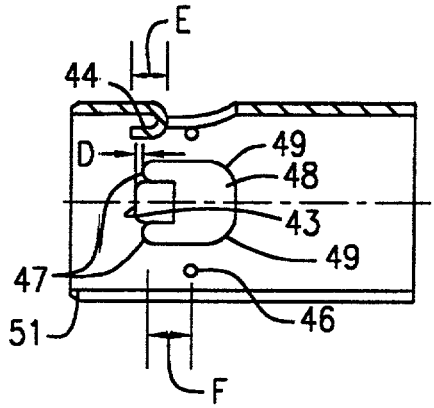
FIG. 7 is a cross sectional side view of the retainer along lines Y-Y.
Figure 8:
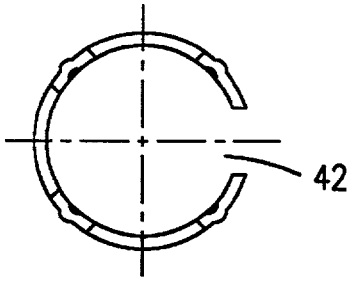
FIG. 8 is a cross-sectional axial view of the retainer along the Z-Z axis in FIG. 6.
Figure 9:
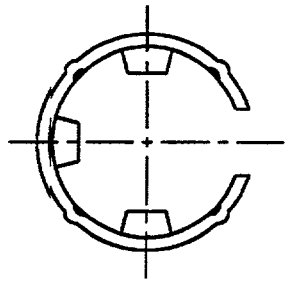
FIG. 9 is a front-end view of the retainer.
Figure 10:
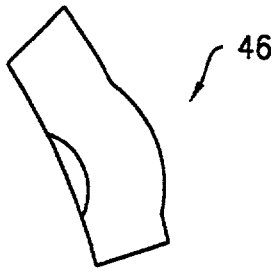
FIG. 10 is a magnified view of the retainer dimple shown in FIG. 8.

The tips 43 of stop tabs as seen in FIGS. 7 and 11 are folded over so that the tips 43 extend rearwardly beyond the most rearward rounded portions 47 of the stop tab openings 48. The distance that the stop tab tip 43 extends beyond the rounded shear cut portion 47 of the opening is identified as letter "D" in FIGS. 7 and 11. The tip 43 holds the hub of the shank rearwardly so that the hub does not contact and rotate against the rearward rounded portions 47 of the tab stop opening as best illustrated in FIG. 11. In FIG. 11 the hub portion of the shank is illustrated as being a distance "D" rearward of the rounded opening portion 47. In one design of the invention the length of distance "D" is 1/16 inch.

During the lifetime of the cutting tool assembly the stop tab tip 43 wears as the tool shank rotates and loads are applied to the cutting tool assembly. As the stop tab tip material wears down, the outwardmost axial position of the cutting bit increases along with the overall axial play of the cutting bit. That is, as the stop tab tip 43 wears down, the shank hub's outward facing groove surface 23 is able to move a greater distance axially outward of the bit holder, and ever closer to the shear line of the rounded tip portion 47. The distance "D" that the tip 43 extends beyond the opening shear cut line is adequately designed to account for mechanical wear of the tip end 43 during the lifetime of the tool. The distance "D" is selected to be greater than the amount of axial wear that normally results on the stop tab tip during the lifetime of the cutting tool assembly.

U.S. Pat. No. 4,484,783 to Emmerich, and U.S. Pat. No. 3,519,309 to Engle et al, disclose retainers having radially protruding surfaces (dimples, bulge) that cooperate with a notch of the bit holder bore. These protruding surfaces of the retainer are spring loaded so as to expand into the bore notch whenever the cutting tool/retainer assembly is inserted into the bore. These type prior art designs often became difficult to remove from bit holders after continued usage on cutting equipment. When these type prior art designs are used on mining and construction equipment, dirt and cutting debris would penetrate the clearances between the shank, retainer and bit holder bore and accumulate in the shanks annular groove. This debris and dirt interferes with the inward radial play of the radially protruding surfaces, making the tools very difficult and sometimes impossible to remove.

The invention includes protruding dimples that are designed to require no radial play and, therefore, do not suffer from the same drawback as the prior art. The retainer sleeve 40 also includes at least one, but preferably a plurality of, outwardly directed dimples 46 which project in a direction opposite the inwardly bent over stop tabs 44. The dimples are generally positioned within the same radial plane about the circumference of the sleeve. The dimples project a distance of between about 0.007-0.020 inches beyond the exterior cylindrical surface of the retainer. The raised dimple of one embodiment protruding from the exterior surface has a diameter of between 0.06-0.10 inches. The outwardly directed dimples 46 are generally uniformly spaced relative to one another about the circumference of the retainer sleeve 40 and extend into the notch 38 at approximately equally spaced intervals. The retainer sleeve 40 includes a plurality of stop tab openings 48. Each of the dimples 46 are positioned centrally between a pair of stop tab openings 48. The openings 48 each define a general D-shaped aperture. The D-shaped opening has no sharp corners or edges. Every corner of the opening is rounded 47/49 to reduce any stress concentration of mechanical forces applied to the retainer during rotating and loading of the cutting tool. The inwardly directed stop tabs 44 and outward dimples 46 of the retainer sleeve 40 co-act with the recessed groove 34 and annular notch 38 to retain the cutting bit 12 within the bore 20 of the bit holder 18 and to prevent axial removal of the cutting bit during normal use while at the same time the stop tabs 44 permit rotatable movement of the cutting bit within the bore 20. In order for the cutting bit to be removed from the bit holder, enough force must be applied to the retainer dimples 46 for them to overcome the sharp 90-degree corner of the notch 38. The cutting bit assembly of FIG. 5 enjoys improved retention of the bit 12 within the holder 18 while also allowing free rotation of the shank 16 within the bore 20.

The flared mouth section 32 of the bore 20 provides for a smooth reception of the dimples about the circumference of the retainer of the cutting tool during installation of the cutting tool into the bit holder. The cooperation of the dimples with a notch improves the strength of the connection between the retainer and bit holder. The new dimpled retainer 40, when used in cooperation with a notched bore, increases the retention of the cutting bit to approximately 2.5x-4x of comparable retainers without dimples, such as Den Bensten U.S. Pat. No. 4,201,421. The dimples apply an improved holding power over the split ring band as shown in U.S. Pat. No. 3,519,309 to Engle. The dimples serve to prevent the cutting tool from being accidentally disengaged from the support block 18 as a result of vibration, impact, or reverse loading of the excavation cutting tool holder assembly 10. Such reverse loading may occur, for example, if the cutting tool assemblies 10 are used in conjunction with a drum and the machine carrying the drum is backed up without the drum rotating.

In prior art road planing construction equipment, cutting bits typically have a smooth retainer exterior surface (without dimples). These type prior art retainers are often ejected from the cutting drum portion that are not engaging the road during operation. The cutting bits on the drum that are not engaged in the cutting action and are positioned off the road in a gravel or dirt shoulder of the road, for instance, have a much greater propensity for being ejected from their bit holders. The present FIG. 5 cutting bit assembly, which includes dimples and notches, improves the retention of cutting bits within the holder, significantly reducing the rate of bit ejection that occurs amongst disengaged cutting bits along the shoulder of the road. This reduction in ejections lessens the amount of time spent on tool replacement and maintenance.

Figure 13:
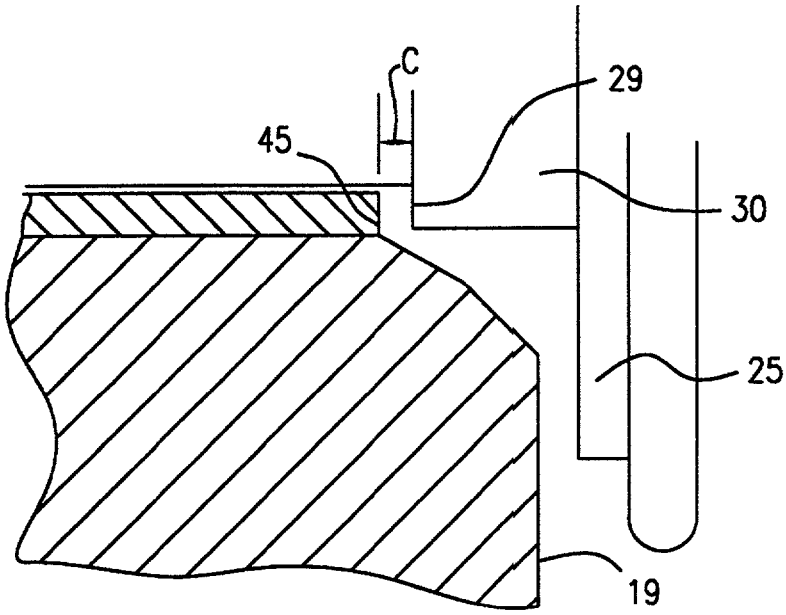
FIG. 13 is a magnified view of FIG. 5.

The relative cooperation between the shank neck 30, shank groove 34 and retainer 40 determines the axial play of the cutting tool assembly shown in FIG. 5. FIG. 11 shows a magnified view of the contact made between the tip 43 of the stop tab 44 and an outward facing groove surface 23 of the groove when the cutting tool (shank) is in its most outward position (FIG. 5) as would occur during reverse loading. FIG. 13 illustrates a magnified view of the forward shank end opposite of the shank end shown in FIG. 11. When the cutting tool (shank) is in its most outward position (FIGS. 5 and 13), the washer 25 is free to displace from contact with the front face 19. When the cutting tool head is impacted against material during operation, the washer 25 is pressed by the shoulder 26 against the front face of the bit holder 19. The inward facing annular neck surface 29 of the neck simultaneously contacts the endface 45 of the retainer as the tool head is impacted against material. The overall axial play of the shank with respect to the bit holder in the embodiment illustrated in FIG. 13 is affected by the cooperation of the annular neck surface 29 with the retainer endface 45, and the cooperation between the stop tab tip 43 and outward facing groove surface 23.

In the FIG. 13 embodiment the endface 45 of the retainer during the lifetime of the tool will wear on account of the above said contact with the inward facing annular neck surface 29. During impact of the cutting tool into earth strata, loads as well as rotational forces are applied to the cutting tool. The heavy impact forces and rotation causes abrasion of the endface 45 of the retainer. As the endface of the retainer wears, the inward facing groove surface 21 comes closer and closer to contacting bendtop 41. Once the endface is worn down a certain amount by the neck of the shank, the shank will additionally begin to contact bendtop 41 as the cutting tool impacts against material. The initiation of this shank contact with the bendtop 41 during the wear life of the tool is determined by the relative dimensions of axial length "A" shown in FIG. 11 and length "C" shown in FIG. 13. The distance "C" between the endface 45 of the retainer and the annular shank neck surface 29 increases as the surface 29 and endface 45 become worn down. Once this distance has increased in length to a distance equal to length "A", the shank begins to contact the bendtop 41. This additional surface contact between the retainer bendtops and shank reduces the rate of wear of the retainer endface. Hence the rate of change of the overall axial play between the shank and retainer is reduced. Axial play between a cutting tool shank and retainer adversely affects wear of the retainer bore. By helping limit the axial play of the cutting tool shank in the retainer, the life expectancy of the retainer is improved.

In a second alternative embodiment of the cutting tool assembly, the entire dimension shapes and geometries of the elements are identical to the embodiment illustrated in FIGS. 1-13 except for the distance between the shank neck surface and retainer endface. The relative position of the shank neck and retainer endface for the second alternative embodiment is illustrated in FIG. 14. In this second embodiment, the distance of the gap "B" between endface 45 and annular neck surface 29 is greater than the stroke distance "A" between the bendtop 41 of the stop tab and the inward facing surface 21. In this embodiment, when the cutting tool head is impacted against material during operation, the washer 25 abuts the front face 19 of the bit holder and inward facing edge surface 21 simultaneously contacts the bendtop 41. In the embodiment illustrated in FIG. 14, the axial play of the shank with respect to the retainer is determined by the cooperation of the shank groove with both the tip 43 and bendtop 41 of the stop tab. In the outward axial position of the cutting bit, the outward facing edge surface 23 contacts the tips 43 of the stop tabs when the cutting bit is in an outward position and inward facing edge surface 21 abuts against the bendtops 41 of the stop tabs when the cutting bit is displaced inward as the cutting bit digs into strata.

The notched bit holder shown in FIGS. 4-14 is used primarily for bump milling and for trenching machines at higher RPM. Generally it is not necessary to operate road planing cutting bits at the higher RPM. These lower RPM cutting tools include a bit holder having a uniform bore without a notch. It should be appreciated that the dimpled retainer cutting tool embodiments disclosed in FIGS. 4-14 could alternatively cooperate with a bit holder having a uniform bore without an annular notch 38, such as Den Besten et al. U.S. Pat. No. 4,201,421. The dimpled retainer 40 holding power when inserted in a uniform bit holder is equivalent to prior art long retainers without dimples, such as Den Besten. The retainer and cutting bit disclosed in FIGS. 4-14, when inserted in a uniform bore (no notch) bit holder, effectively rotates to prevent uneven wear of the cutting head. The protruding dimple is gradually smashed between the shank and uniform bore during cutting operations. The dimple becomes smashed radially inward until the exterior surface of the retainer is almost uniform and the dimple extends only 0.001 inch beyond the cylindrical outer surface of the retainer. Hence, the dimpled retainer 40 can be effectively used with either a notched 38 bit holder, as shown in FIG. 5, or it can be used with a uniform bore bit holder.

Figure 15:
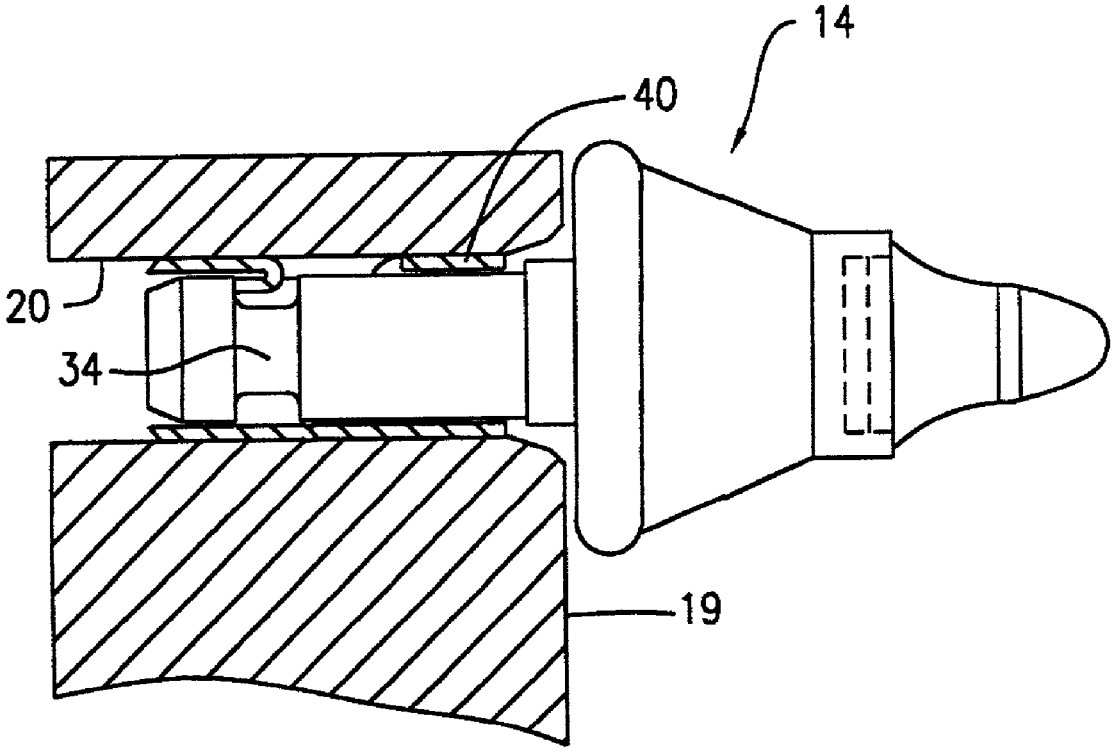
FIG. 15 is a partial cross-section of a third embodiment of the invention.

The present folded over stop tab spring retainer design can be alternatively designed without dimples as well-known in the prior art. The ability of the smooth retainer to secure the cutting bit within the bit holder is far less than the dimpled retainer embodiment illustrated in FIG. 5. Such an alternative embodiment of the subject invention is illustrated in FIG. 15, where like numerals are used to designate like elements among the figures. In this embodiment, the bit holder 18 includes a uniform cylindrical bore 20 (no notch) for receiving the cylindrical shank portion 16 of the cutting bit 12. As with the embodiment shown in FIG. 5, the shank portion 16 includes an annularly shaped groove 34. The bit holder 18 does not, however, include the annular notch or dimples as illustrated in FIG. 5. In this embodiment, the cutting tool assembly includes a retainer sleeve 40, which is disposed between the shank portion 16 of the cutting bit 12 and the bore 20 of the bit holder 18. The retainer 40 includes the same structure as shown in FIG. 6, but cooperates with the shank 16 and bore 20 in a different way. In the embodiment in FIG. 15, the shoulder 26 of the cutting bit contacts the front face of the bit holder whenever the cutting tool strikes against strata, and there is no washer. Simultaneously with the shoulder contacting the front face, the neck's annular surface 29 contacts against the endface 45 of the retainer halting inward movement of the cutting tool. Alternatively, as in the first embodiment, the endface of the retainer and cooperating annular neck surface 29 can be designed similar to the embodiment in FIG. 14 wherein the gap distance "B" between the surfaces 29 and 45 is greater than the stroke length "A" between inward facing edge surface 21 and bendtop 41. In such an embodiment, the inward facing groove surface contacts the bendtops of the stop tabs in the cutting tool most inward position.

The retainer sleeve 40 is made of resilient spring steel such as spring steel 1050 between 0.033-0.066 inches. In one embodiment design, the thickness of the sheet steel used to make the retainer is 0.045 inches. In one design of the retainer, the steel grain is oriented to be parallel to the central axis of the retainer to help reduce perpendicular and horizontal fractures as shown at 7 in FIG. 3.

The cutting bits of the cutting tool assemblies of the subject invention may be rotatably retained within the bit holders, while, at the same time, successfully resisting axial removal during excavating operations. The inventions disclosed provide for reduced axial play and prevent contact between the shank hub and retainer shear cut lines reducing both wear and fractures to the retainer, improving the life expectancy of the retainer with respect to the prior art. The improved dimple design improves attachment of the retainer within the bit holder while at the same time permitting the dimpled retainer to be easily installed into the bit holder. In addition, these objectives are met in a cost effective, efficient manner which does not jeopardize tool life nor overly complicate the assembly and disassembly of the cutting tool.

The disclosed embodiments improve the effective life expectancy of the retainers and reduce the amount of maintenance required on mining and construction cutting equipment.

The subject invention has been described in an illustrative manner. It is to be understood that the terminology which has been used is intended to be in the nature of words of description rather than of limitation. Many modifications and variations of the present invention are possible in light of the above teachings. Therefore, within the scope of the appended claims, the present invention may be practiced other than as specifically described.

What is claimed is:

1. A cutting tool assembly for rotatable retention within a bore of a bit holder wherein the bore includes a groove, said assembly comprising:

a cutting tool;

a retainer sleeve carried by the cutting tool, and the retainer sleeve including a radially outward projecting dimple that is received within the groove;

wherein said retainer sleeve has a cylindrical circumference and a thickness dimension;

the amount of radial projection of said dimple beyond the cylindrical surface of the retainer sleeve is between a minimum equal to about 15 percent of the thickness dimension of the retainer sleeve so as to provide sufficient holding force to rotatably retain the cutting tool within the bore during operation and a maximum equal to about 30 percent of the thickness dimension of said retainer sleeve so as to provide for a maximum force to allow the removal of the cutting tool from the bore without the necessity of excessive force.

2. A cutting tool assembly according to claim 1, wherein said retainer sleeve includes a plurality of said dimple spaced relative to one another about the circumference of said retainer sleeve.

3. A cutting tool assembly according to claim 1, wherein said dimple is generally semi-spherical.

4. A cutting tool assembly according to claim 3 wherein said dimple has a diameter of between about 0.06-0.10 inches.

5. A cutting tool assembly according to claim 3 wherein said retainer sleeve has a plurality of said dimple.

6. A cutting tool assembly according to claim 1 wherein said dimple extends between about 0.007-0.020 inches beyond an exterior cylindrical surface of said retainer sleeve.

7. A retainer for use in conjunction with a cutting tool, said retainer comprising:

a retainer sleeve carried by the cutting tool and including a radially outward projecting dimple;

wherein said retainer sleeve has a cylindrical circumference and a thickness dimension:

the amount of radial projection of said dimple beyond the cylindrical surface of the retainer sleeve is between about 15 percent and about 30 percent of the thickness dimension of said retainer sleeve.

8. A retainer according to claim 7, wherein said retainer sleeve includes a plurality of said dimple equally spaced relative to one another about the circumference of said retainer sleeve.

9. A retainer according to claim 7 wherein said dimple extends between about 0.007-0.020 inches beyond an exterior cylindrical surface of said retainer sleeve.

10. A retainer according to claim 7 wherein said dimple has a diameter of between about 0.06-0.10 inches.

11. A retainer according to claim 7 wherein said retainer sleeve has a plurality of said dimple.

12. A retainer according to claim 7 wherein said retainer sleeve has an endface, and a bottom end, wherein a slit extends from said bottom end to said endface.

13. A cutting tool assembly, said assembly comprising:

a cutting tool:

a retainer sleeve carried by the cutting tool, and including a radially outward protruding surface;

wherein said retainer sleeve has a cylindrical circumference and a thickness dimension, the amount of radial projection of said protruding surface beyond the cylindrical surface of the retainer sleeve is between about 15 percent and about 30 percent of the thickness dimension of said retainer sleeve.

14. A retainer for use in conjunction with a cutting tool, said retainer comprising:

a retainer sleeve carried by the cutting tool and including a radially outward protruding surface;

wherein said retainer sleeve has a cylindrical circumference and a thickness dimension;

the amount of radial projection of said protruding surface beyond the cylindrical surface of the retainer sleeve is between about 15 percent and about 30 percent of the thickness dimension of said retainer sleeve.

15. A retainer according to claim 14 wherein said retainer sleeve has an endface, and a bottom end, wherein a slit extends from said bottom end to said endface.

16. A generally cylindrical retainer for use in conjunction with a cutting tool, said retainer comprising:

a retainer sleeve carried by the cutting tool and including at least two radially outward projecting dimples;

wherein said retainer sleeve has a central longitudinal axis and a thickness dimension, and all of said at least two dimples are generally located within a common radial plane;

the amount of radial projection of each one of said at least two dimples beyond the cylindrical surface of the retainer sleeve is between about 15 percent and about 30 percent of the thickness dimension of said retainer sleeve, wherein said retainer sleeve is constructed from steel.

17. A retainer according to claim 16 wherein said at least two dimples extend between about 0.007-0.020 inches beyond an exterior cylindrical surface of said retainer sleeve.

18. A retainer according to claim 17 wherein each one of said at least two dimples has a diameter of between about 0.06-0.10 inches.

* * * * *